US008961064B2

(12) United States Patent
Ramos et al.

(10) Patent No.: US 8,961,064 B2
(45) Date of Patent: Feb. 24, 2015

(54) SYSTEM AND METHOD FOR SCREED EXTENSION IDENTIFICATION

(71) Applicant: Caterpillar Paving Products Inc., Brooklyn Park, MN (US)

(72) Inventors: Igor S. Ramos, Minnetonka, MN (US); Robert W. Lindsey, Washington, IL (US); LaTanya G. Turner, St. Paul, MN (US); Daniel Podany, Peoria, IL (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 13/854,393

(22) Filed: Apr. 1, 2013

(65) Prior Publication Data

US 2014/0294503 A1 Oct. 2, 2014

(51) Int. Cl.
*E01C 19/42* (2006.01)
*E01C 23/03* (2006.01)

(52) U.S. Cl.
CPC ..... *E01C 19/42* (2013.01); *E01C 23/03* (2013.01)
USPC ..... 404/84.05; 404/77; 404/79; 404/95; 404/118

(58) Field of Classification Search
CPC ..... E01C 23/03; E01C 19/42
USPC ..... 404/77, 79, 84.05, 95, 118
See application file for complete search history.

(56) References Cited

U.S. PATENT DOCUMENTS

| | | | | |
|---|---|---|---|---|
| 5,222,829 | A | 6/1993 | Mogler et al. | |
| 7,716,831 | B2 * | 5/2010 | Richard | 29/890.09 |
| 8,282,312 | B2 * | 10/2012 | Braddy et al. | 404/84.05 |
| 8,297,875 | B1 * | 10/2012 | Kopacz et al. | 404/77 |
| 2009/0257825 | A1 * | 10/2009 | Nelson | 404/95 |
| 2010/0256878 | A1 * | 10/2010 | Zegowitz | 701/50 |
| 2012/0263532 | A1 | 10/2012 | Rutz et al. | |

FOREIGN PATENT DOCUMENTS

JP 2005090043 A 4/2005

* cited by examiner

*Primary Examiner* — Raymond W Addie
(74) *Attorney, Agent, or Firm* — Miller, Matthias & Hull LLP

(57) ABSTRACT

A screed system is provided. The screed system includes a base screed. The screed system includes an extension member, wherein the extension member is detachably coupled to the base screed. The screed system also includes an identification module associated with the extension member. The identification module is configured to provide an indication of the extension member. The screed system further includes a controller, wherein the controller is configured to determine a parameter associated with the extension member based on the indication. Further, the identification module and the controller are configured to communicate with each other.

16 Claims, 3 Drawing Sheets

SYSTEM AND METHOD FOR SCREED EXTENSION IDENTIFICATION

TECHNICAL FIELD

The present disclosure relates to a system and method for screed extension identification and more specifically for identifying a parameter related to a screed extension member.

BACKGROUND

A width of a screed system associated with a paving machine may need to be widened or shortened depending on the required paving width. This is accomplished by detachably coupling one or more extension members to a base screed of the paving machine. For example, a screed system that is 6 meters wide fully extendible could be configured for 12 meters with the installation of the extension members. In known systems, a status of coupling or decoupling of the extension member is manually fed to the paving machine by an operator through an operator interface device or service specific tools, in order to configure the machine size. Alternatively, in other systems the machine size may be configured by adding or removing jumpers in a machine harness In some machines, in order to avoid determining the overall machine length, the system is run in an open-loop configuration, that does not require specific knowledge of the machine size.

For example, J.P. Published Application Number 2005/090043 provides a paving width indicating device for a paving machine which includes a main screed and extendable auxiliary screeds. The paving width indicating device allows an operator to check a paving width. In the paving machine, automatic winding measuring tapes are fixed to outermost portions of the respective auxiliary screeds and tips of scales pulled out of the measuring tapes are fixed to outermost portions of the main screed, respectively.

The above solutions however require manual intervention and hence are time consuming and laborious. Moreover, they prove to be ineffective when a number of extension members are utilized. Hence, there is a need to provide an improved system for the detection and identification of the extension members coupled to the screed system of the paving machine.

SUMMARY OF THE DISCLOSURE

In one aspect of the present disclosure, a screed system is provided. The screed system includes a base screed. The screed system includes an extension member, wherein the extension member is detachably coupled to the base screed. The screed system also includes an identification module associated with the extension member. The identification module is configured to provide an indication of the extension member. The screed system further includes a controller, wherein the controller is configured to determine a parameter associated with the extension member based on the indication. Further, the identification module and the controller are configured to communicate with each other.

In another aspect of the present disclosure, a paving machine is provided. The paving machine includes a main frame. The paving machine also includes a tractor. The paving machine further includes a screed system coupled to the tractor. The screed system includes a base screed. The screed system includes an extension member, wherein the extension member is detachably coupled to the base screed. The screed system also includes an identification module associated with the extension member. The identification module is configured to provide an indication of the extension member. The screed system further includes a controller, wherein the controller is configured to determine a parameter associated with the extension member based on the indication. Further, the identification module and the controller are configured to communicate with each other.

In yet another aspect of the present disclosure, a screed system is provided. The screed system includes a base screed and an extension member. The extension member is detachably coupled to the base screed. The screed system also includes a means for providing an indication associated with the extension member. The screed system includes a means for determining a parameter associated with the extension member based on the indication. Further, the means for providing an indication associated with the extension member and the means for determining a parameter associated with the extension member based on the indication are configured to communicate with each other.

Other features and aspects of this disclosure will be apparent from the following description and the accompanying drawings.

DETAILED DESCRIPTION

Figure 1:
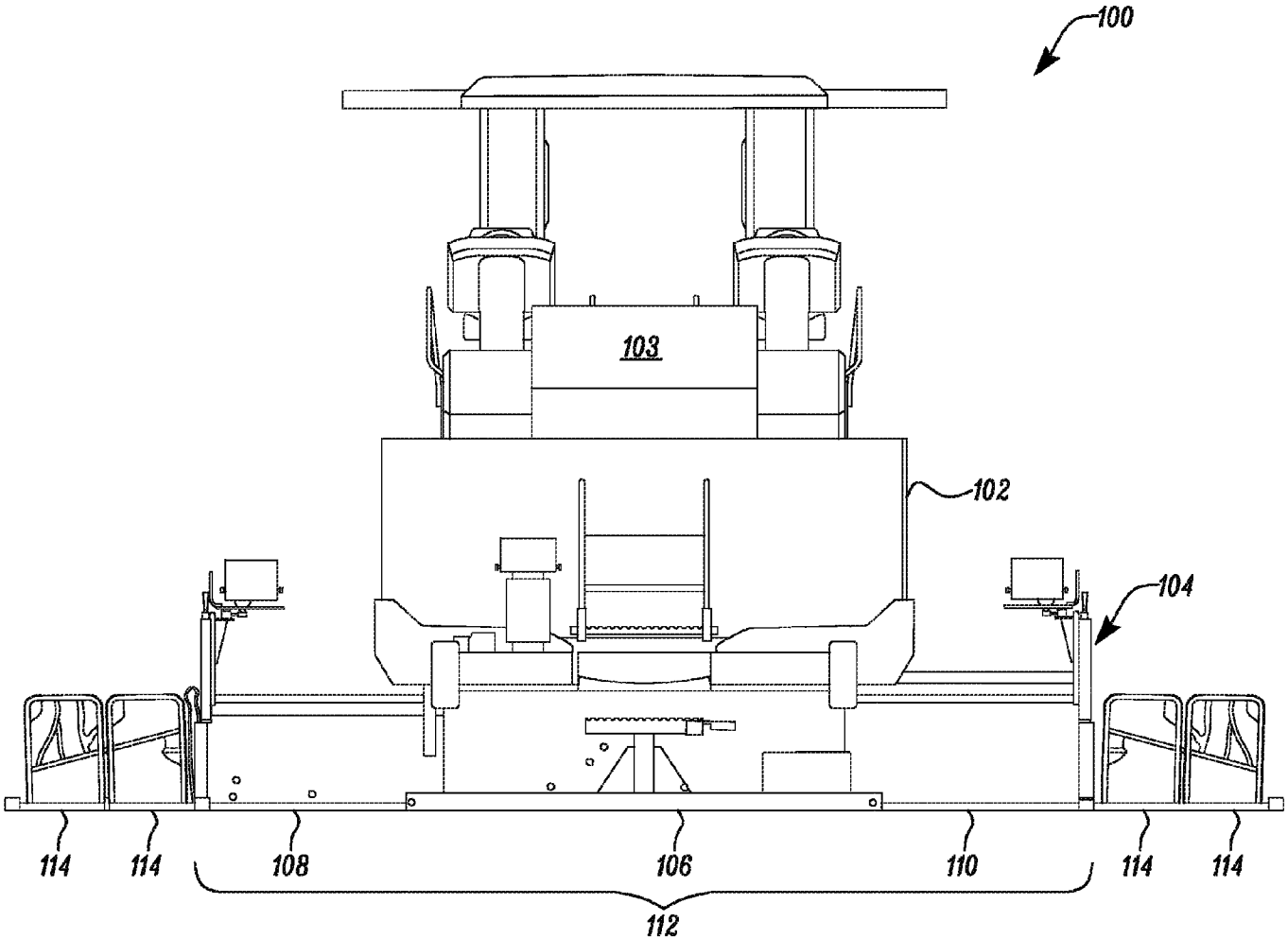
FIG. 1 is an exemplary paving machine having a screed system, according to one embodiment of the present disclosure.

Wherever possible, the same reference numbers will be used throughout the drawings to refer to the same or the like parts. FIG. 1 shows a paving machine 100, according to one embodiment of the present disclosure. The paving machine 100 includes a main frame 102 and a tractor 103. The paving machine 100 further includes a screed system 104 having a main screed 106, a first extender 108 and a second extender 110, hereinafter collectively termed as a base screed 112. The main screed 106 is coupled to a tractor 103 tow arms (not shown) and follows behind the tractor 103. In an alternative embodiment, the main screed 106 may be mounted in front of the tractor 103. Further, the first and second extenders 108, 110 are mounted rearwardly of the main screed 106. Alternatively, the first and second extenders 108, 110 may also be mounted in front of the main screed 106.

The base screed 112 is configured to compact and level a paving material like an asphalt mixture on a surface during construction. The first and second extenders 108, 110 are provided to enable coupling of the one or more extension members 114 to the base screed 112. During operation, the base screed 112, more specifically the main screed 106 and the first and second extenders 108, 110, move in various positions with respect to the paving machine 110, as per system requirements. The movements include sliding and/or tilting along various axes with respect to the paving machine 100. In various embodiments, a hydraulic system, an electric system, a mechanical system or a combination thereof may be used to actuate various parts of the screed system 104. Further, the paving machine 100 may include a control panel in an operator station, in order to enable an operator to control the movement of the screed system 104.

Figure 2:
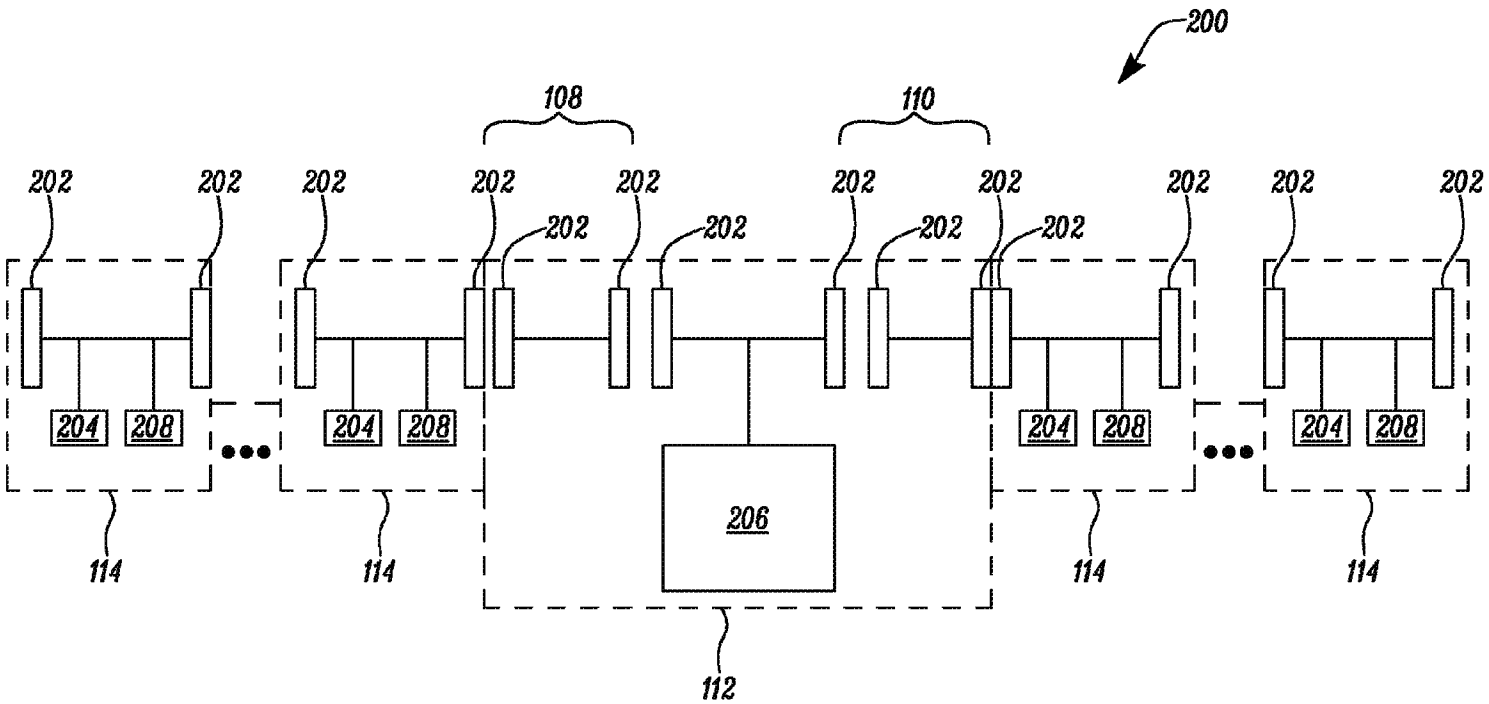
FIG. 2 is a block diagram of a screed extension identification system for the paving machine shown in FIG. 1.

The first and second extenders 108, 110 may be coupled to the main screed 106 by a plurality of connectors 202 (shown in FIG. 2). The connectors 202 are manually bolted to each other by techniques known in the art. Further, referring to FIG. 1, a plurality of extension members 114 are coupled in series to the first and second extenders 108, 110 respectively, in order to widen an overall length of the base screed 112 on either side. The base screed 112 is required to be widened for achieving a desired paving width. The extension members 114 are coupled to each other or any one of the first and second extenders 108, 110 by similar connectors 202. Other fastening mechanisms known in the art may also be utilized.

A person of ordinary skill in the art will appreciate that the number of extension members 114 and the configuration or arrangement of the extension members 114 coupled to either side of the base screed 112 may vary based on the application. More particularly, as illustrated in the accompanying figures, the plurality of extension members 114 are coupled to one another in series or a linear arrangement which may or may not be symmetrical. Dimensions, and number of the extension members 114 that may be coupled to the base screed 112 may vary as per system design and requirements.

The present disclosure relates to a screed extension identification system 200. Referring to FIG. 2, a block diagram of the screed extension identification system 200 is shown. An identification module 204 is provided in association with each of the extension members 114. The identification module 204 is physically embedded in a wiring harness of each of the extension members 114. The identification module 204 is configured to provide an indication of the respective extension members 114. More specifically, the identification module 204 includes active or passive elements in order to automatically identify when the given extension member 114 is coupled to the base screed 112, based on the indication. The indication is any one or a combination of, but not limited to, a resistance value, a unique identification code, radio frequency identification (RFID) tag, and the like.

One of ordinary skill in the art will appreciate that each of the indications associated with the extension member 114 corresponds to a unique parameter of the given extension member 114. In one embodiment, the parameter includes a length of the extension member 114. For example, in one situation, one extension member 114 has a length of 0.25 meters, a second extension member 114 has a length of 0.75 meters, a third extension member 114 has a length of 1.25 meters, and so on. Accordingly, the indications provided for each of the above mentioned extension members 114 is distinct based on the length of that given extension member 114. It should be understood that the indication provided by the identification module 204 is such that different indications are provided by the identification module 204, in response to the coupling of the extension members 114 of varying length to the base screed 112.

Further, as shown in FIG. 2, each of the identification modules 204 associated with the respective extension member 114 is communicably coupled to a controller 206. The controller 206 is located on-board the paving machine 100. The controller 206 is configured to receive signals from the plurality of identification modules 204. The controller 206 is further configured to determine the parameter associated with the extension member 114, based on the indication. The parameter associated with the extension member 114 may be any one or a combination of the length of the extension member 114, a position of the extension member 114 relative to a fixed point on the base screed 112, and the like.

As described earlier, the identification module 204 can include a variety of the active or passive elements for providing the indication associated with the extension member 114. In one embodiment, the identification module 204 includes a resistor associated with the extension member 114. Since the identification module 204 is present within each of the extension members 114, physical coupling of the extension members 114 to each other or the first and second extenders 108, 110 causes the resistors of the identification module 204 to be coupled to one another to create a resistive network via the connectors 202. The resistors of the identification module 204 may thus be coupled in a series and/or parallel configuration. A person of ordinary skill in the art will appreciate that the connectors 202 may include necessary components such as ports, in order to allow for the formation and interconnection between the resistors of the different identification modules 204 associated with the corresponding extension members 114. Moreover, the resistor within each of the identification modules 204 provides a different resistance value unique to each of the extension members 114 depending on their respective length or dimensions. For example, an extension member 114 having a length of 0.75 meters has a relatively greater resistance and a higher voltage drop as compared to that of an extension member 114 having a length of 0.25 meters. One of ordinary skill in the art will appreciate that the resistor is the passive element and the corresponding voltage drop across the extension member 114 provides the indication of the parameter of the given extension member 114. The parameter may include the length of the respective extension member 114 and the location of the extension member 114 in the resistive network.

Alternatively, the identification module 204 can be the active element. In another embodiment, the identification module 204 is a unique identification code module. In this situation, the identification module 204 provides a unique identification code corresponding to the parameter associated with the extension member 114. The unique identification code is any one or a combination of numerical, alphabetical characters, symbolic characters, and the like. Further, multiple identification modules 204 associated with the plurality of the extension members 114 are connected in order to form a network having any known topology. The connection between the different identification modules 204 may be established when the respective extension member 114 is added to the screed system 104. These connections may include wired connections running through the connectors 202 or wireless connections to the base screed 104. Control signals indicative of the unique identification code associated with the extension member 114 are transmitted or broadcast to the controller 206 over the network depending on the type of connection formed between the identification modules 204 and the base screed 104. Accordingly, the controller 206 identifies the extension member 114 and/or the position of the extension member 114 with respect to the network, based on the control signal.

In yet another embodiment, the identification module 204 may be embodied as an RFID module. In this scenario, the identification module 204 provides an RFID tag as an indication of the extension member 114 being coupled to the base screed 112. Accordingly, the RFID tag includes generation of a radio frequency signal. The controller includes a RFID receiver for receiving the radio frequency signal. Based on signal strength of the radio frequency signal measured by the RFID receiver, the location and distance of the respective extension member 114 from a fixed reference point on the screed system 104 may be determined by known methods.

Accordingly, based on the indication received from the identification module 204, the controller 206 can automatically identify the length and/or relative positioning of the extension member 114 coupled to the base screed 112, with minimal human intervention. It should be noted that the controller 206 may be capable of handling multiple signals broadcast or transmitted to the controller 206 in case of the active elements present within the identification module 204. Alternatively, in the situation where the identification module 204 includes the passive element, the controller 206 may determine the connection established between the extension member 114, and consequently the identification module 204 associated with the extension member 114 with the base screed depending on the voltage drop experienced across the resistive network formed. Moreover, in one embodiment, the communication between the identification modules 204 and the controller 206 may be established regularly after predetermined periods of time to ensure that the given extension member 114 is securely coupled to the base screed 104.

In one embodiment, the controller 206 is coupled to a display unit and notifies an operator of the determined parameter associated with the extension member 114 by way of a suitable display. Further, the controller 206 determines the overall length of the base screed 112 and the extension member 114. This in turn can be utilized to provide improved heating to the screed system 104 of the paving machine 100.

As shown in FIG. 2, a heating element 208 is provided in association with each of the extension members 114. The heating element 208 is communicably coupled to a power source (not shown) on-board the paving machine 100. The power source 100 is further coupled to the controller 206. Based on the determined length of each of the extension members 114 coupled to the screed system 104, the controller 206 is configured to control a quantity of heat provided by the power source to each of the respective heating elements 208. Accordingly, the heating elements 208 are automatically configured to provide the required quantity of heat to a bottom surface of the extension member 114 for heating of the paving material leveled on the ground.

Further, in one embodiment incorporating a resistive network, the controller 206 can perform an anti-aliasing function. For example, in one case, the controller 206 may be unable to distinguish between two extension member configurations because an equivalent resistance of one extension member 114 may be confused with the equivalent resistance of another extension member 114. In this case, a predefined dataset is stored in a database (not shown) communicably coupled to the controller 206. The predefined dataset may include allowable and/or disallowable configurations of the extension members 114, range of nominal resistance of heating elements 208 for each extension member 114, and the like. The controller 206 is configured to correlate the determined configuration with the predefined dataset, in order to ascertain if the determined configuration is supportable by the system 200. The system 200 may display an appropriate error message in case the configuration is unsupportable.

The controller 206 may embody a single microprocessor or multiple microprocessors that includes a means for receiving signals from the components of the screed extension identification system 200. Numerous commercially available microprocessors may be configured to perform the functions of the controller 206. It should be appreciated that the controller 206 may readily embody a general machine microprocessor capable of controlling numerous machine functions. A person of ordinary skill in the art will appreciate that the controller 206 may additionally include other components and may also perform other functionality not described herein. It should be understood that the embodiments and the configurations and connections explained herein are merely on an exemplary basis and may not limit the scope and spirit of the disclosure.

A method of identification of the extension member 114 coupled to the base screed 112 is explained in connection with FIG. 3.

INDUSTRIAL APPLICABILITY

The operator of the paving machine needs to setup or extend the width of the screed system to match the desired road paving width. In an extendible screed system, the screed width is adjusted by detachably coupling extension members to the base screed. The extension members are installed in a variety of configurations to achieve the desired paving width. Each of these extension members may have a varying length. Known systems include manually configuring the overall length of the paving machine based on the extension members coupled to the base screed. This process is laborious and time consuming.

The present disclosure relates to a system and method for screed extension identification. The screed extension identification system 200 disclosed herein can automatically identify the length of the extension member 114 coupled to the base screed 112, and hence the overall width of the screed system 104 is determined with minimal human intervention. Further, the system 200 may identify unsupported configurations that exceed electrical or mechanical limits of the paving machine 100. The system 200 can also perform machine diagnostics, such as verifying whether the resistance of the installed heating element 208 is within expected range.

Knowledge of the length of the extension members 114 attached to the base screed 116 may allow the system 200 to determined the overall machine size. Moreover, the knowledge of the machine size and the length of each of the extension members 114 can be used to better manage the electric screed heating system. As discussed earlier, each of the extension members includes the heating element 208. Based on the determined length and/or number of the extension members 114 identified by the system 200, a proportional amount of heating power may be delivered to the heating element 208. This may minimize system heat-up time and enable the screed system 104 to reach a target temperature relatively fast. Hence, the screed extension identification system 200 provides an overall improved system management.

Figure 3:
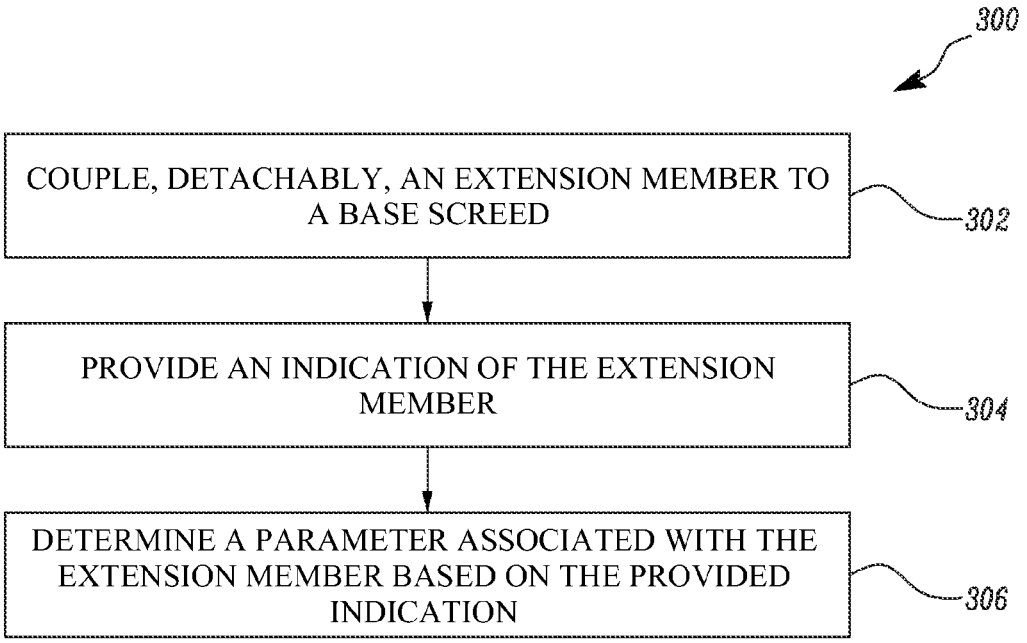
FIG. 3 is a method of operation of the screed extension identification system.

FIG. 3 illustrates the method of operation of the screed extension identification system 200. At step 302, the plurality of extension members 114 are detachably coupled to the base screed 112. The coupling is done by manually bolting the extension members 114 to each other or the base screed 112 in a desired configuration. At step 304, the indication of the extension member 114 is provided by the identification module 204 of the respective extension member 114 to the controller 206. As explained above, the identification module 204 includes the active or the passive element to identify the length of the coupled extension member 114, based on the indication provided. The indication may include the resistor value, the unique identification code or the RFID tag.

At step 306, the controller 206 determines the parameter associated with the extension member 114. The parameter may be the length of the extension member 114 or the position of the extension member 114 relative to a fixed point on the base screed 112.

In one embodiment, based on the determined parameter or length associated with the extension member 114, the controller 206 identifies whether the configuration of the extension member 114 is electrically and/or mechanically supportable. The controller 206 correlates the determined configuration with the predefined dataset of allowable configurations of the extension member 114. In another embodiment, the controller 206 may send control signals to the power source to control the quantity of an energy provided to the heating element 208 of the respective extension member 114 based on the determined length of the extension member 114. Further, the controller 206 notifies the operator of the determined length associated with the extension member 114 by the suitable display.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A screed system comprising:
a base screed;
an extension member, wherein the extension member is detachably coupled to the base screed;
an identification module associated with the extension member, the identification module configured to provide an indication of the extension member;
a heating element associated with the extension member, the heating element coupled to a power source; and
a controller, the controller configured to determine a parameter associated with the extension member based on the indication, wherein the identification module and the controller are configured to communicate with each other and the controller is configured to control an energy provided by the power source to the heating element based on the determined parameter associated with the extension member.

2. The screed system of claim 1, wherein the extension member is coupled to at least one of a second extension member and the base screed through an electrical connector.

3. The screed system of claim 2, wherein the indication of the extension member includes a resistance value associated with a resistor associated with the identification module.

4. The screed system of claim 3, wherein the identification module and the second identification module are configured to form a resistive network with the resistor and a second resistor associated with the second identification module through corresponding electrical connectors.

5. The screed system of claim 1, wherein the indication of the extension member includes a unique identification code associated with the identification module.

6. The screed system of claim 1, wherein the indication of the extension member includes a radio frequency identification (RFID) tag associated with the identification module.

7. The screed system of claim 1, wherein the identification module is configured to communicate with the base screed through a wireless network.

8. The screed system of claim 1, wherein the controller is further configured to correlate the determined parameter associated with the extension member with a predefined dataset for determining electrical and mechanical supportability.

9. The screed system of claim 1, wherein the controller is further configured to correlate the determined parameter associated with the extension member and predefined dataset for determining electrical and mechanical supportability.

10. The screed system of claim 1, wherein the controller is configured to notify an operator of the determined parameter associated with the extension member.

11. A paving machine comprising:
a main frame;
a tractor;
a screed system coupled to the tractor, the screed system comprising:
a base screed;
an extension member, wherein the extension member is detachably coupled to the base screed;
an identification module associated with the extension member, the identification module configured to provide an indication of the extension member;
a heating element associated with the extension member, the heating element coupled to a power source; and
a controller, the controller configured to determine a parameter associated with the extension member based on the indication, wherein the identification module and the controller are configured to communicate with each other and the controller is configured to control an energy provided by the power source to the heating element based on the determined parameter associated with the extension member.

12. The paving machine of claim 11, wherein the parameter associated with the extension member includes at least one of a length of the extension member and a positioning of the extension member relative to a fixed point on the base screed.

13. The paving machine of claim 11, wherein the identification module is configured to communicate with the base screed through a wired network or a wireless network.

14. The paving machine of claim 11, further comprising a heating element associated with the extension member, the heating element coupled to a power source.

15. The paving machine of claim 14, wherein the controller is further configured to control an energy provided by the power source to the heating element based on the determined parameter associated with the extension member.

16. A screed system comprising:
a base screed;
an extension member, wherein the extension member is detachably coupled to the base screed;
means for providing an indication associated with the extension member; and
means for determining a parameter associated with the extension member based on the indication;
means for heating the extension member;
means for controlling the means for heating the extension member based upon the determined parameter; and
wherein the means for providing an indication associated with the extension member and the means for determining a parameter associated with the extension member based on the indication are configured to communicate with each other.

* * * * *